US010775056B2

(12) United States Patent
Anderson

(10) Patent No.: US 10,775,056 B2
(45) Date of Patent: Sep. 15, 2020

(54) NATATORIUM DEHUMIDIFIER

(71) Applicant: UNITED MAINTENANCE, INC., Atlanta, GA (US)

(72) Inventor: Adam J. Anderson, Marietta, GA (US)

(73) Assignee: UNITED MAINTENANCE, INC., Atlanta, GA (US)

( * ) Notice: Subject to any disclaimer, the term of this patent is extended or adjusted under 35 U.S.C. 154(b) by 855 days.

(21) Appl. No.: 14/847,632

(22) Filed: Sep. 8, 2015

(65) Prior Publication Data

US 2016/0069575 A1 Mar. 10, 2016

Related U.S. Application Data

(60) Provisional application No. 62/047,264, filed on Sep. 8, 2014.

(51) Int. Cl.

| | |
|---|---|
| ***F25B 7/00*** | (2006.01) |
| ***F24F 3/14*** | (2006.01) |
| ***E04H 12/00*** | (2006.01) |
| ***F24F 5/00*** | (2006.01) |
| ***F24F 3/147*** | (2006.01) |
| ***E04H 4/12*** | (2006.01) |
| *F24F 3/153* | (2006.01) |
| *E04H 4/00* | (2006.01) |

(52) U.S. Cl.

CPC ..... *F24F 3/1405* (2013.01); *E04H 4/129* (2013.01); *F24F 3/147* (2013.01); *F24F 5/0071* (2013.01); *E04H 4/00* (2013.01); *F24F 3/153* (2013.01); *F25B 7/00* (2013.01)

(58) Field of Classification Search

CPC .. F24F 3/153; F24F 5/0035; F24F 3/14; F24F 200/14; F24F 2203/12; F24F 3/147; F24F 5/0071; F25B 40/02; Y02B 30/545; E04H 4/12; E04H 4/1209; E04H 4/129

USPC ..... 62/90, 77, 304, 259.1

See application file for complete search history.

(56) References Cited

U.S. PATENT DOCUMENTS

| | | | | |
|---|---|---|---|---|
| 1,837,798 | A * | 12/1931 | Shipley | F24F 3/153 165/228 |
| 4,094,167 | A | 6/1978 | Madsen | |
| 4,189,929 | A * | 2/1980 | Russell | F24F 3/1405 62/175 |
| 4,517,810 | A | 5/1985 | Foley et al. | |
| 4,557,116 | A | 12/1985 | Kittler | |
| 4,658,594 | A * | 4/1987 | Langford | E04H 4/14 62/176.5 |
| 4,667,479 | A | 5/1987 | Doctor | |
| 4,761,966 | A | 8/1988 | Stark | |
| 4,770,001 | A | 9/1988 | Kittler | |

(Continued)

FOREIGN PATENT DOCUMENTS

| | | | |
|---|---|---|---|
| CN | 201363831 | Y | 12/2009 |
| CN | 101957097 | A | 1/2011 |

(Continued)

*Primary Examiner* — Jianying C Atkisson
*Assistant Examiner* — Daniel C Comings
(74) *Attorney, Agent, or Firm* — Gardner Groff & Greenwald, PC

(57) ABSTRACT

The present invention provides improved dehumidification and/or air conditioning systems, and associated methods and equipment, for example for use in a natatorium housing a swimming pool, or other buildings which may enclose sources of humidity or otherwise resulting in a need for air treatment.

11 Claims, 12 Drawing Sheets

(56) References Cited

U.S. PATENT DOCUMENTS 4,796,439 A * 1/1989 Yamada ..... F24D 11/0214 62/159
4,841,733 A 6/1989 Dussault et al.
4,903,503 A * 2/1990 Meckler ..... F02G 1/043 62/238.3
5,179,998 A 1/1993 Des Champs
5,181,552 A * 1/1993 Eiermann ..... F24F 11/00 165/228
5,305,822 A 4/1994 Kogetsu et al.
5,493,871 A * 2/1996 Eiermann ..... F24F 3/153 62/173
5,613,372 A 3/1997 Beal et al.
5,682,754 A 11/1997 Groenewold
5,992,161 A * 11/1999 O'Halloran ..... F24F 3/153 62/173
6,141,979 A * 11/2000 Dunlap ..... F24F 3/044 165/8
6,523,359 B1 2/2003 Posch
7,219,505 B2 * 5/2007 Weber ..... F24F 3/153 62/156
7,458,228 B2 12/2008 Lagace et al.
7,581,408 B2 9/2009 Stark
7,770,411 B2 8/2010 Knight et al.
7,845,185 B2 12/2010 Knight et al.
8,028,438 B2 * 10/2011 Pedtke ..... F24F 13/222 106/222
8,689,580 B2 4/2014 Lakdawala et al.
8,999,027 B1 * 4/2015 Baxter ..... E04H 4/14 55/385.2
2008/0173035 A1 7/2008 Thayer et al.
2009/0211282 A1 * 8/2009 Nishimura ..... F25B 30/06 62/238.6
2011/0296860 A1 * 12/2011 Honda ..... F24D 11/0214 62/222
2012/0222440 A1 * 9/2012 Matsui ..... F25B 13/00 62/159
2016/0320105 A1 * 11/2016 Okazaki ..... F25B 25/005

FOREIGN PATENT DOCUMENTS

CN 102226600 A 10/2011
CN 202470241 U 10/2012
CN 202928016 U 5/2013
GB 2120777 A 12/1983
WO 03106898 A1 12/2003
WO WO 2008136763 A2 * 11/2008 ..... F24F 3/0442
WO WO-2008136763 A2 * 11/2008 ..... F24F 3/0442

* cited by examiner

| UNIT STAGE# | TOUCH SCREEN CONTROLS PLC | AIR COOLED CHILLER | WATER COOLED CHILLER | CHILLED WATER COIL | WATER BASED COND. COIL | DRY COOLER | BOILER OR DUCT FURNACE | PLATE FRAME HEAT EXCH. | EXHAUST FANS & OA/RA DAMPERS | RUN AROUND COILS | OUT DOOR AIR ENTHALPY CONTROLS |
|---|---|---|---|---|---|---|---|---|---|---|---|
| 1 | Y | Y | | Y | | | Y | | | | Y |
| 2 | Y | Y | | Y | | | Y | | Y | | Y |
| 3 | Y | Y | | Y | | | Y | | Y | Y | Y |
| 4 | Y | | Y | Y | Y | Y | Y | | | | Y |
| 5 | Y | | Y | Y | Y | Y | Y | Y | | | Y |
| 6 | Y | | Y | Y | Y | Y | Y | Y | Y | | Y |
| 7 | Y | | Y | Y | Y | Y | Y | Y | Y | Y | Y |

FIG. 9

NATATORIUM DEHUMIDIFIER

CROSS-REFERENCE TO RELATED APPLICATIONS

This application claims the benefit of U.S. Provisional Patent Application Ser. No. 62/047,264 filed Sep. 8, 2014, the entirety of which is hereby incorporated herein by reference for all purposes.

TECHNICAL FIELD

The present invention relates generally to the field of HVAC systems and equipment, and more particularly to systems and methods relating to a natatorium dehumidifier/air conditioner, and to retrofitting existing natatorium dehumidifiers/air conditioning systems for improved performance and reliability.

BACKGROUND

The typical design for many packaged refrigerant based dehumidifiers is fundamentally flawed because of the propensity of the system to become contaminated by moisture during repairs. This is particularly the case with dehumidifiers used in indoor swimming pool or natatorium facilities. Replacement packaged dehumidifier systems are extremely expensive and it is more economical to retrofit the customer's existing unit with other components in a different arrangement. Refrigerant based dehumidifiers are overly complicated for many applications due to the quantity of control valves in the refrigerant circuit making it hard for the average technician to troubleshoot. Refrigerant based dehumidifiers also contain a significant volume of refrigerant. For example, a 60 ton Desert Aire™ unit or equivalent system holds about 400 lbs of R22. Typically, refrigerant based dehumidifiers comprise one or more coils (carrying refrigerant) that are positioned inside of the air handler. For example, providing a flow of air over the coils provides for heat transfer so that heat energy is transferred from the refrigerant (e.g., passing through the one or more coils) to the air moving through the air handler and across the one or more coils to dehumidify and provide air conditioning within the natatorium. Due to the inherent nature of the dehumidifier and surroundings, the air handler will likely be humid or comprising a substantially large relative humidity such that chlorinated water vapor is present.

For example, as a common decontamination method for large bodies of water such as a swimming pool, chlorine will likely be used (in doses) to decontaminate the pool water. As such, any water vapor from the natatorium (and generally produced by the pool water and chlorine mix), will produce the chlorinated water vapor. Thus, as the refrigerant based dehumidifier runs, the chlorinated water vapor is being drawn within the air handler. According to several accounts, when refrigerant based dehumidifiers are serviced (e.g., compressor replacement, etc.), the moist air inside of the air handler contaminates the coils carrying the refrigerant with chlorinated water vapor, whereby the chlorinated water vapor contacts the inside surface of the coils or piping thereof and forms copper-chloride salt. After the dehumidifier is serviced, the coils are evacuated of air using a vacuum pump, thereby causing the moisture to boils away and leaving the copper-chloride salt in the coils.

As the system is recharged with refrigerant, the copper-chloride salt dissolves and contaminates the refrigerant circuit causing acidic refrigerant. The acidic refrigerant in turn causes the dehumidifier to have continuous compressor failures in the form of grounded and shortened windings. Thus, refrigerant based dehumidification systems during a repair will more than likely become contaminated by chlorinated water vapor, which will likely cause repetitive compressor failures due to grounded or shortened windings. Furthermore, Standard Desert Aire™ dehumidifiers and other refrigerant based dehumidifiers are limited in the amount of outdoor air they can bring into a building such as a natatorium for housing a swimming pool or other enclosed area.

Accordingly, it can be seen that needs exist for improved dehumidifiers and air conditioners. It is to the provision of a natatorium dehumidifier meeting these and other needs that the present invention is primarily directed.

SUMMARY

In example embodiments, the present invention provides a natatorium dehumidifier or dehumidifier/air conditioning system. In one aspect, the present invention relates to a dehumidifier/air conditioner including an air handler and a refrigerant based chiller. The air handler has a contained volume therein and includes at least a chilled water coil, a reheat coil, and a heating coil. According to example forms, the refrigerant based chiller positioned outside of the air handler. According to some example forms, the air handler comprises chlorinated water vapor therein. According to preferred example forms, the chilled water coil, the reheat coil, and the heating coil comprise waterside coils. The chiller is positioned outside of the air handler in an environment generally free from moisture or chlorinated water vapor. According to example forms, the air handler comprises a return air damper and an outdoor or outside air damper. Optionally, the air handler further a runaround coil positioned adjacent the return air damper and a runaround coil positioned adjacent the outdoor air damper.

In another aspect, the invention relates to a method of retrofitting an existing dehumidifier/air conditioner including removing refrigerant components from inside of the air handler of the existing dehumidifier/air conditioner; installing one or more waterside components within the existing air handler, the waterside components being chosen based off of efficiency and expense; and providing a refrigerant based chiller, the refrigerant based chiller positioned outside of the air handler. According to some example forms, the refrigerant based chiller is in the form of an air cooled chiller. According to some example forms, the refrigerant based chiller is in the form of a water cooled chiller. Generally, the one or more waterside components include a chilled water coil, a reheat coil, a heating coil, and one or more runaround coils. Optionally, a boiler or duct furnace positioned outside of the air handler. Optionally, a plate frame heat exchanger is provided.

In another aspect, the invention relates to a natatorium dehumidifier including an air handler and a refrigerant based chiller positioned outside of the air handler. The air handler having a contained volume and having chlorinated water vapor therein. According to example forms, the air handler includes at least a chilled water coil, a reheat coil, and a heating coil. According to preferred forms, the chilled water coil, the reheat coil, and the heating coil comprise waterside coils. According to preferred forms, the chiller is positioned outside of the air handler in an environment free from moisture or chlorinated water vapor. According to example forms, the air handler includes a return air damper and an outdoor air damper. Optionally, a runaround coil is positioned adjacent the return air damper and a runaround coil is positioned adjacent the outdoor air damper.

In another aspect, the invention relates to a natatorium including an enclosure containing an indoor pool, and a natatorium dehumidifier comprising an air handler and a chiller containing a refrigerant. The enclosure of the natatorium and the air handler define a treated air containment space, and the refrigerant of the chiller is isolated from and positioned outside of the treated air containment space.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of example embodiments of the invention, and are not restrictive of the invention, as claimed.

BRIEF DESCRIPTION OF THE DRAWINGS

FIG. 9 is a table showing a plurality of options for retrofitting an existing dehumidifier/air conditioner system according to a ninth example embodiment of the present invention.

DETAILED DESCRIPTION OF EXAMPLE EMBODIMENTS

Figure 1:
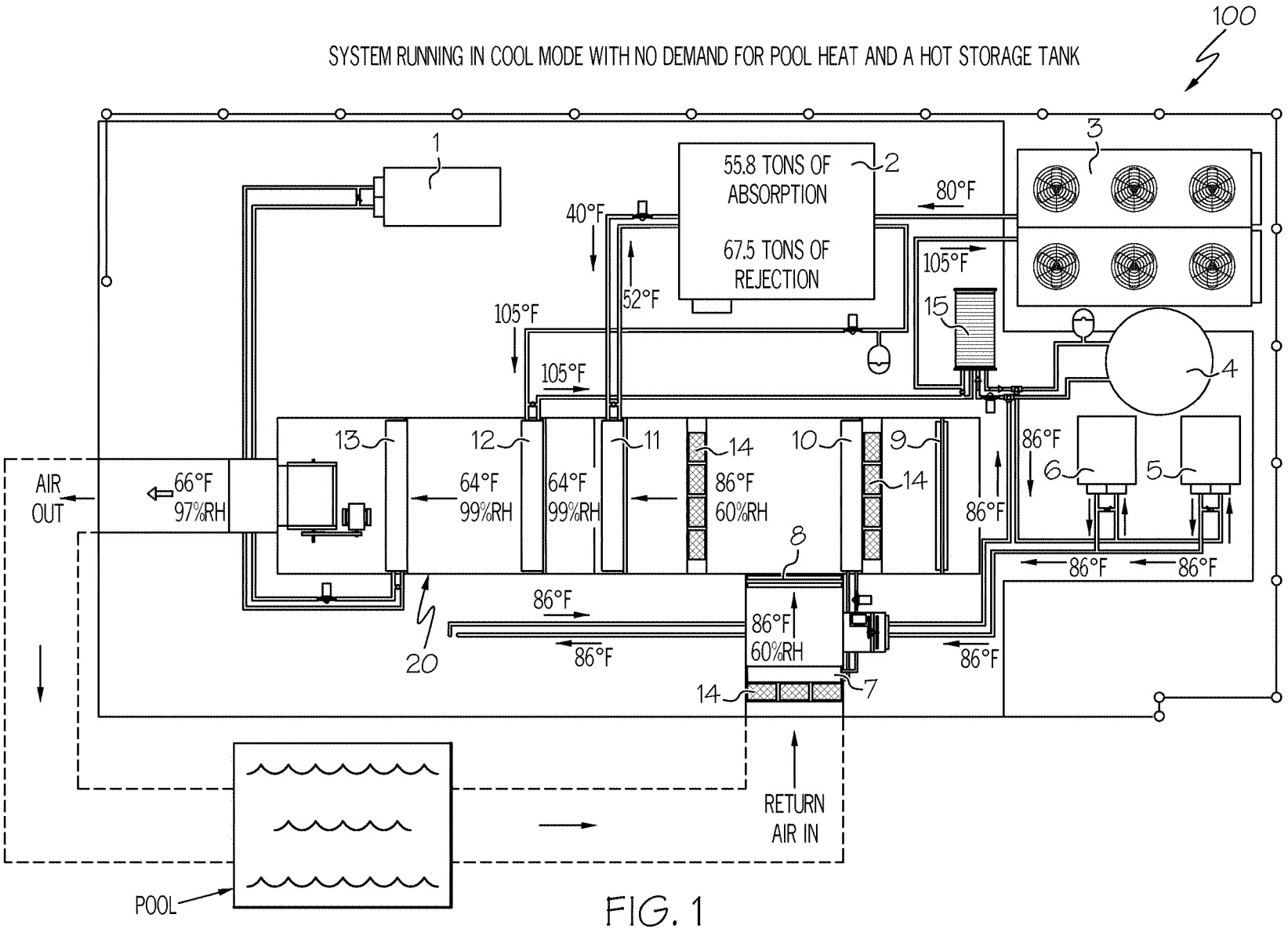
FIG. 1 is a schematic of a dehumidifier/air conditioner system according to a first example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present invention provides improved dehumidification and/or air conditioning systems, and associated methods and equipment, for example for use in a natatorium facility housing an indoor swimming pool, or other buildings which may enclose sources of humidity or otherwise resulting in a need for air treatment. The dehumidifier/air conditioner system of the present invention preferably comprises four modes of operation including: 1) cooling, 2) dehumidifying, 3) economizing, and 4) heating. In example forms, each of these modes (1-4) include sub modes, which equates to rejecting heat to different components within the system to be utilized later for energy recovery.

As depicted throughout the figures, the dehumidifier/air conditioner system of the present invention generally comprises a plurality of components. For example, according to example embodiments of the present invention, the dehumidifier/air conditioner generally comprises a boiler 1, a chiller 2, a cooler 3, a hot water storage tank 4, one or more pool boilers 5, 6, a runaround coil 7, a return air damper 8, an outdoor or outside air damper 9, a runaround coil 10, a chilled water coil 11, a reheat coil 12, a heating coil 13, one or more air filter racks 14, and a plate frame heat exchanger 15. According to some example forms and as will be described below, one or more of the components of the dehumidifier/air conditioner can be omitted. According to some example forms, the system generally comprises three air filter racks 14 for receiving filters therein. Generally, the air filter racks 14 are provided in front of the runaround coils 7, 10, and in front of one or more of the other coils (chilled water coil 11, reheat coil 12, heating coil 13). An air handler 20 is positioned relative to the components as shown in the figures whereby air comprising a first temperature and a first relative humidity is drawn into the air handler 20, and whereby air comprising a second temperature and a second relative humidity is dispersed from the air handler 20. Optionally, as will be described below, outdoor air may be drawn into the air handler 20 according to some example forms of the present invention.

Generally, the air handler 20 comprises a contained volume that is occupied by a flow of air passing therethrough. Generally, the air (e.g., return air in) is relatively saturated with moisture and contains chlorinated water vapor, for example, as most pools will generally comprise at least some chlorine to cause at least a portion of the water vapor therefrom to be at least partially chlorinated. According to example forms, the air handler 20 generally houses a plurality of the components including the runaround coil 7 adjacent the return air damper 8, the outdoor air damper 9 adjacent the runaround coil 10, the chilled water coil 11, the reheat coil 12, and the heating coil 13. Preferably, the components 7, 10, 11, 12, 13 are housed within the air handler 20 and all have waterside coils, for example, having coils in which water is the medium flowing therethrough, which can vary depending on the coil and desired temperature. According to one example form, the return air is at a temperature of about 86 degrees F. and 60% relative humidity, and the air being dispersed or blown out of the system (e.g., air out) is at a temperature of about 66 degrees F. and about 97% relative humidity (see FIG. 1). According to another example form, the return air is at a temperature of about 86 degrees F. and about 60% relative humidity, and the air being dispersed or blown out of the system (e.g., air out) is about 115 degrees F. and about 29% relative humidity (see FIG. 8).

According to example forms, all or substantially all of the refrigeration or refrigerant components are contained inside the chiller 2 (e.g., comprising refrigerant within its coils) and are free from being positioned within the air handler or a moisture laden environment where chlorine or chlorinated water vapor is present. Thus, when servicing of the dehumidifier/air conditioner is performed, the coils of the components within the air handler 20 (e.g., moist and chlorinated environment) are outside of the potentially chlorinated airflow and thereby are prevented from being contaminated by the chlorine, and thus, do not contaminate the refrigerant since the coils are carrying water therethrough. Likewise, when servicing of the chiller 2 is performed, the coils of the chiller 2 are not contaminated by the chlorine since the chiller 2 and the refrigerant coils thereof are in an environment free from chlorine or chlorinated water vapor.

The cooling mode will preferably be initiated when the return air entering the machine has a sensible temperature that is higher than the desired space temperature. Regardless of the cooling sub mode, the chiller will preferably run to maintain about a 40 degrees Fahrenheit (40° F.) chilled water temperature, the three way valve at the reheat coil will be in a bypass position, and the supply air fan will run at 60 hertz (full speed). The other valves at the plate frame heat exchanger 15 and in the pool water loop will be opened, closed or modulated based on what sub mode the system is running in while in the cooling mode. The three way chilled water valve at the cooling coil will be modulated by a proportional-integral-derivative (PID) loop as the space temperature changes giving the system tight control. These subsequent sub modes will be determined by the programmable logic controller henceforth known as the PLC. Below is a description of each sub mode within the cooling mode explaining how the devices within the design function in each sub mode.

With reference now to the drawing figures, wherein like reference numbers represent corresponding parts throughout the several views, FIG. 1 shows a dehumidifier/air conditioner 100 in a cooling mode with no demand for pool heat and a hot storage tank. When the swimming pool temperature is at its set point and the hot water storage tank 4 temperature is warmer than the condenser water leaving the chiller 2 the system is said to be in "pure cooling mode". In this mode, the condenser water leaving the chiller 2 is bypassed around the plate frame heat exchanger 15 and is cooled at the remote air side condenser before reentering the chiller 2. Moist return airflow from the natatorium structure enclosing a chlorinated water pool is delivered via a return air duct or other return airflow conduit to the enclosed air handler 20, where the natatorium airflow is conditioned or treated by dehumidification, cooling, heating and/or filtering, and then returned via an air out (conditioned air) supply duct or other supply air delivery conduit to the enclosure of the natatorium structure or pool area. One or more fans or blower units preferably drive the airflow through the system. The natatorium enclosure, air handler and supply and return ducts define a substantially enclosed treated air containment space, and the chiller and refrigerant coils are located outside of and isolated from this treated air containment space to avoid potential contamination of the refrigerant with chlorine or other contaminants that may be present within the treated air containment space. A chilled water delivery pipe or conduit delivers cooling water from the chiller to the chilled water coil within the air handler to cool and/or dehumidify air within the treated air containment space without exposing the refrigerant or refrigerant coils to potential contaminants from the treated air.

Figure 2:
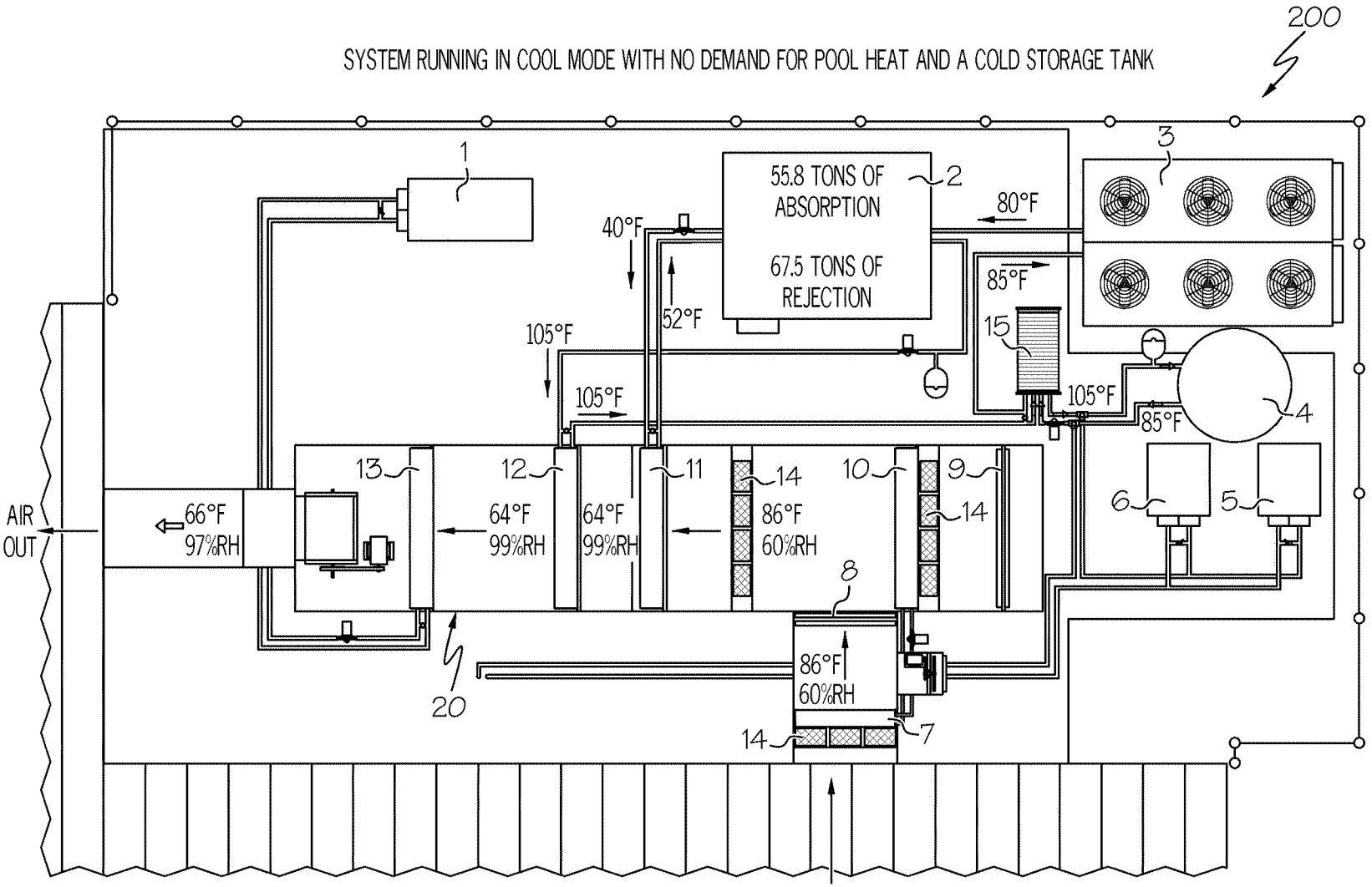
FIG. 2 is a schematic of a dehumidifier/air conditioner system according to a second example embodiment of the present invention.

FIG. 2 shows dehumidifier/air conditioner 200 in a cooling mode with no demand for pool heat and a cold storage tank. When the swimming pool temperature is at its set point and the hot water storage tank 4 is colder than the condenser water leaving the chiller 2, the system rejects heat to the storage tank 4 to later release to the pool. This is accomplished by sending condenser water through the plate frame heat exchanger 15 while also switching the valves over at the storage tank 4 in order to circulate the water in the storage tank 4 back to the plate frame heat exchanger 15. Later, if there is a demand for pool heat while the system is not producing hot condenser water, the storage tank's water is released to the swimming pool through the related changeover valves.

In an economizer mode, as will be described below, one or more of the systems of the present invention generally include the return and outdoor air dampers 8, 9, and a set of energy recovery coils known as a runaround loop. In the colder months of the year when the system is in cooling mode, if the enthalpy of the outdoor air is lower than that of the return air, the PLC begins opening the outdoor air dampers 9 and closing the return air damper 8. The PLC simultaneously sends an enable signal to the frequency drive that runs the exhaust fan. The exhaust fan then begins ramping up from 20 to 60 hertz based on a signal from a pressure transducer that reads the buildings static pressure relative to atmospheric pressure. This allows the building to be kept at a slightly positive pressure thereby lowering the evaporation rate from the swimming pool and preventing infiltration of outside air into the structure. A mixed air sensor before the chilled water coil 11 serves two functions. First, it prevents the chilled water coil 11 from freezing while the unit is economizing by not allowing the mixed air temp to get lower than about 40 degrees F. Second, it controls the modulation of the dampers 8, 9 by comparing the mixed air temperature change to the change in space temperature thereby giving a PID control loop for economizer control. If the system is in heating mode and the structure needs a large amount of ventilation air due to chlorine concentrations in the air being too high, from a swim meet or other event, the pump for the runaround loop comes on and heat is taken from the exhaust air and rejected to the incoming fresh air. This serves as an energy reclaim for the fresh air system much like an energy recovery wheel.

Figure 3:
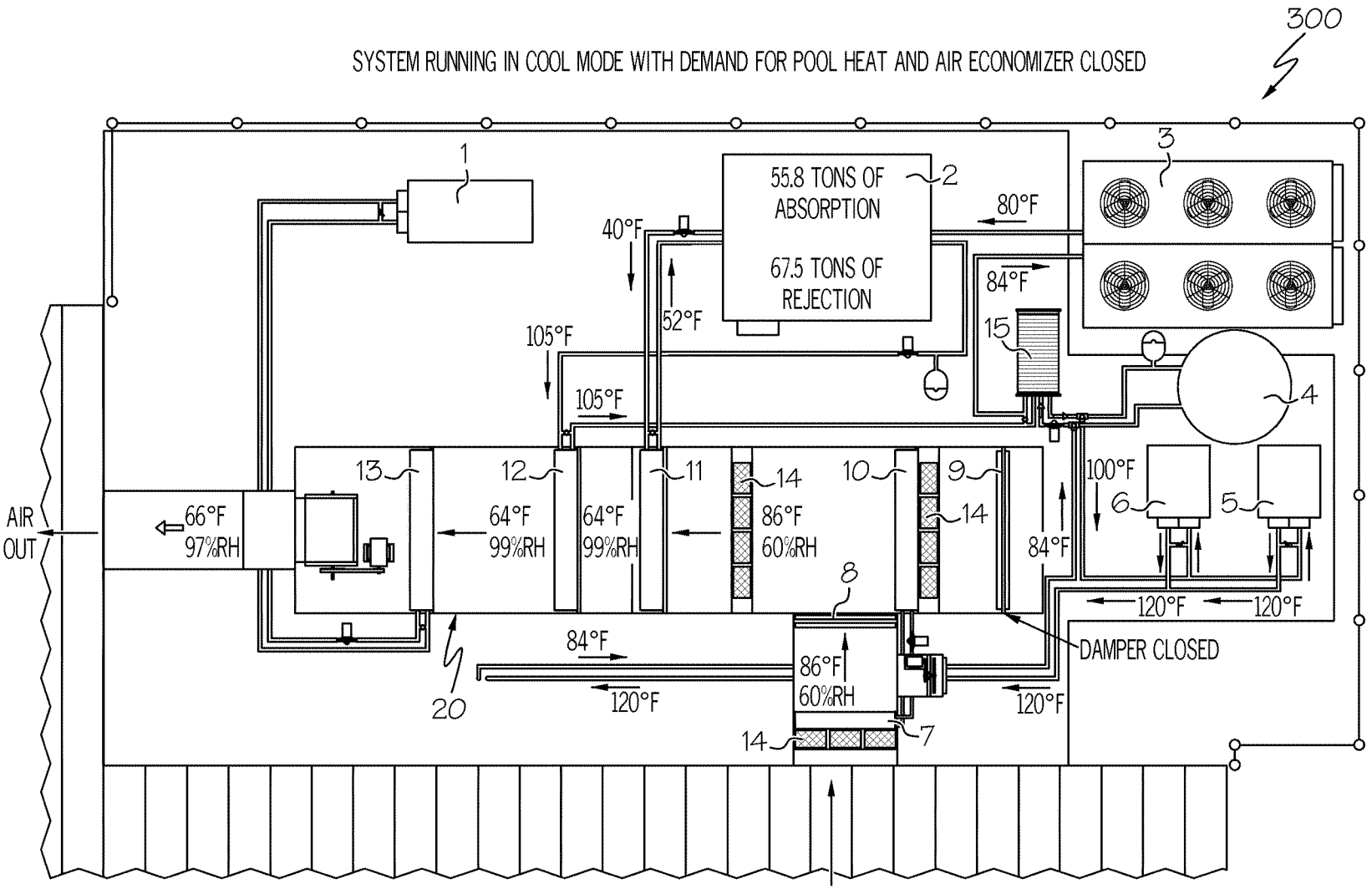
FIG. 3 is a schematic of a dehumidifier/air conditioner system according to a third example embodiment of the present invention.
Figure 4:
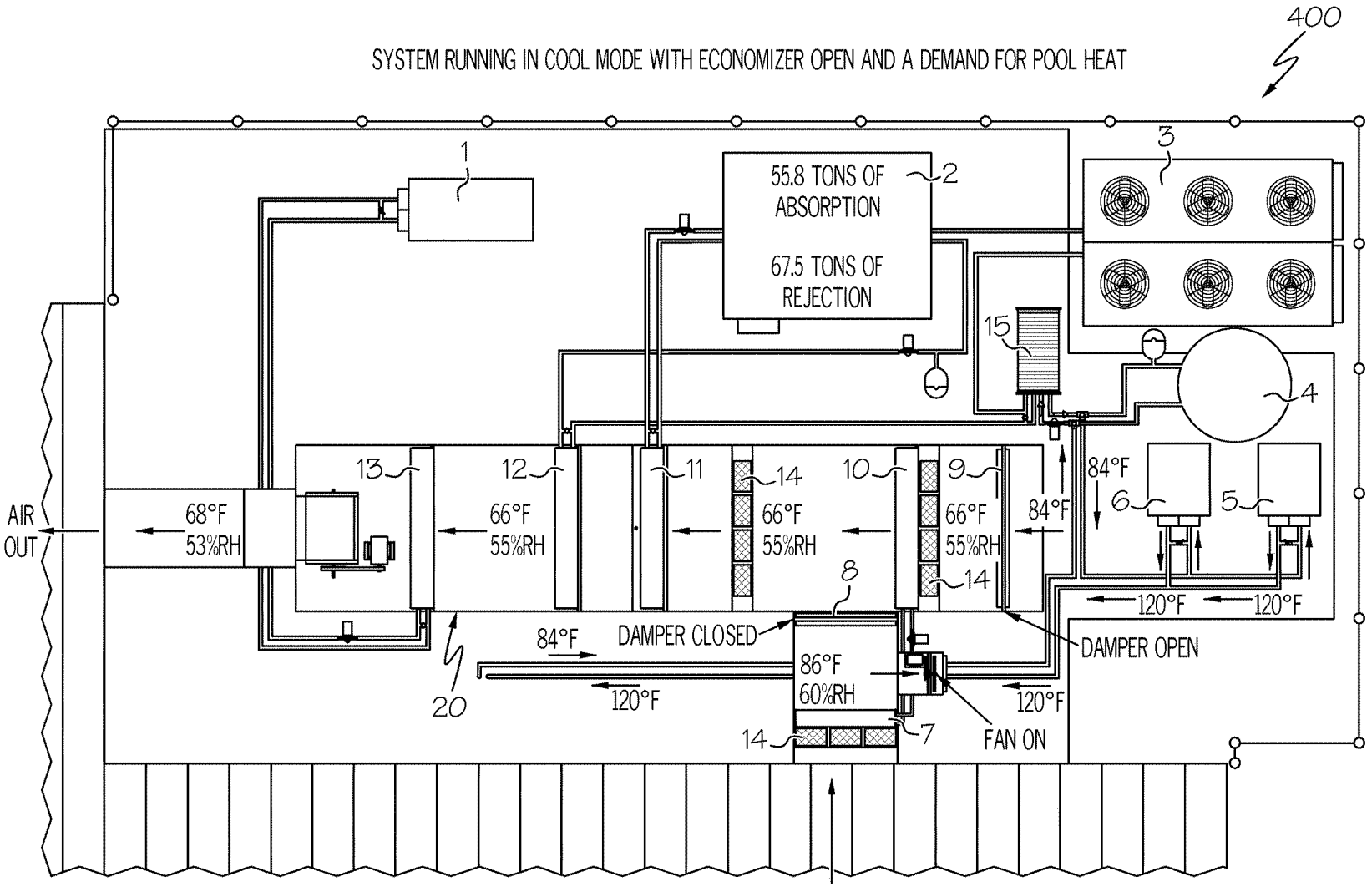
FIG. 4 is a schematic of a dehumidifier/air conditioner system according to a fourth example embodiment of the present invention.

FIG. 3 shows dehumidifier/air conditioner 300 in a cooling mode with a demand for pool heat and the air economizer closed, and FIG. 4 shows dehumidifier/air conditioner 400 in a cooling mode with a demand for pool heat and the air economizer open. Generally, when the swimming pool's temperature is below its set point the system rejects heat to the pool. This is accomplished by sending condenser water through the plate frame heat exchanger 15 to preheat the water going to the pool boilers 5, 6. If the pool temperature continues to drop then the PLC will signal the boilers 5, 6 to run and the pool will be brought up to the correct temperature.

The dehumidification mode will be initiated when the relative humidity of the return air entering the machine is higher than the set point temperature. Regardless of the dehumidification sub mode, the chiller 2 will run to maintain about a 40 degrees F. chilled water temperature and the three way valve at the reheat coil 12 will modulate to supply hot condenser water to the reheat coil 12. As space temperature drops below the set point the three way valve to the reheat coil 12 will send more flow through the coil. As the humidity in the space decreases the three way valve at the chilled water coil 11 will bypass chilled water around the cooling coil. On other versions of the system, a boiler is used for reheat and the supply fan is set to 30 hertz to maintain energy compliance. The other valves at the plate frame heat exchanger 15 and in the pool water loop will be opened, closed, or modulated by the PLC based on what sub mode the system is running in while in the dehumidification mode.

Figure 5:
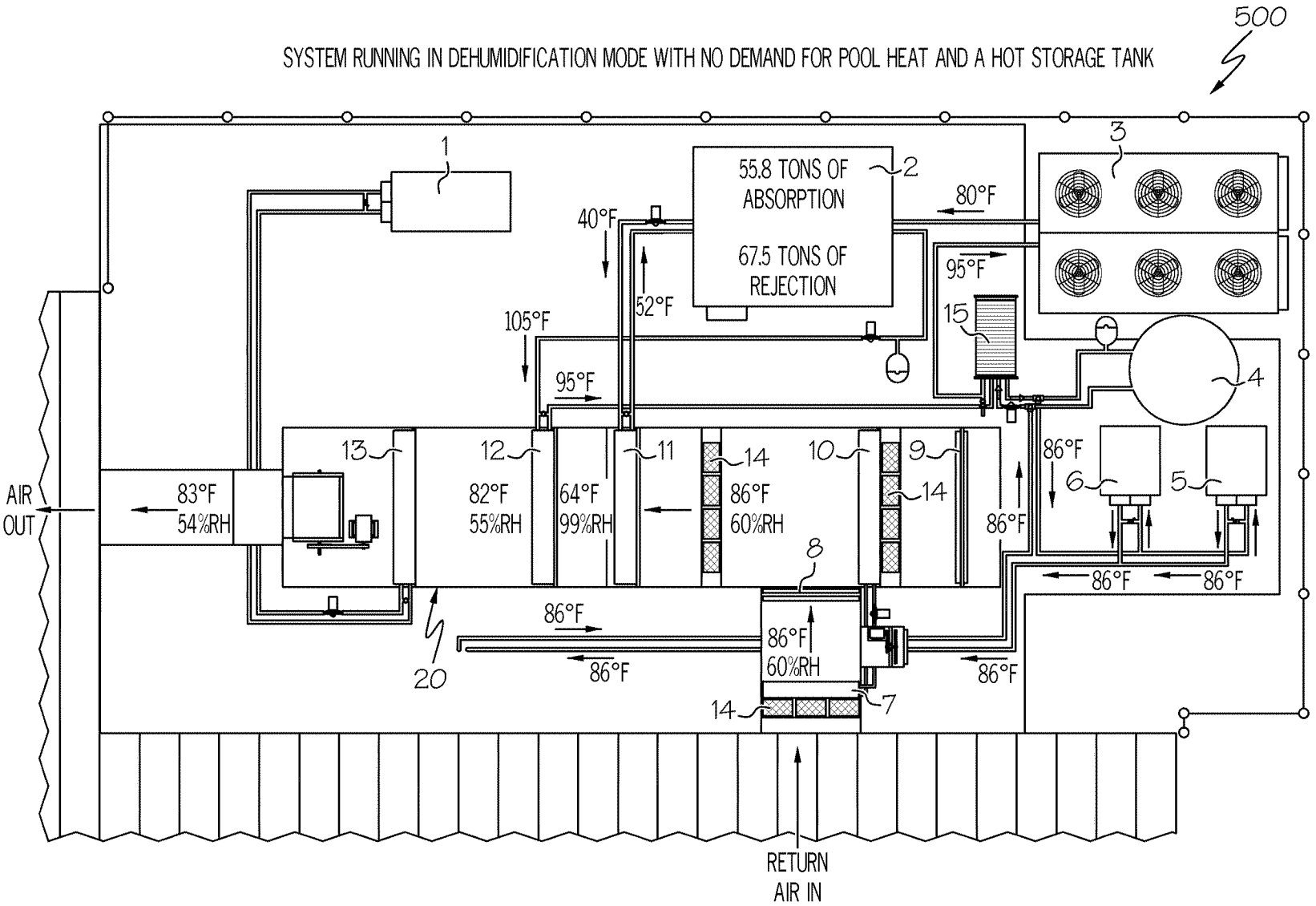
FIG. 5 is a schematic of a dehumidifier/air conditioner system according to a fifth example embodiment of the present invention.

FIG. 5 shows dehumidifier/air conditioner 500 in a dehumidification mode with no demand for pool heat and a hot storage tank 15. When the swimming pool temperature is at its set point and the hot water storage tank's temperature is warmer than the condenser water leaving the reheat coil 12, the system is said to be in "pure dehumidification mode". In this mode, the condenser water leaving the reheat coil 12 is bypassed around the plate frame heat exchanger 15 and is cooled as needed at the remote air side condenser before reentering the chiller 2.

Figure 6:
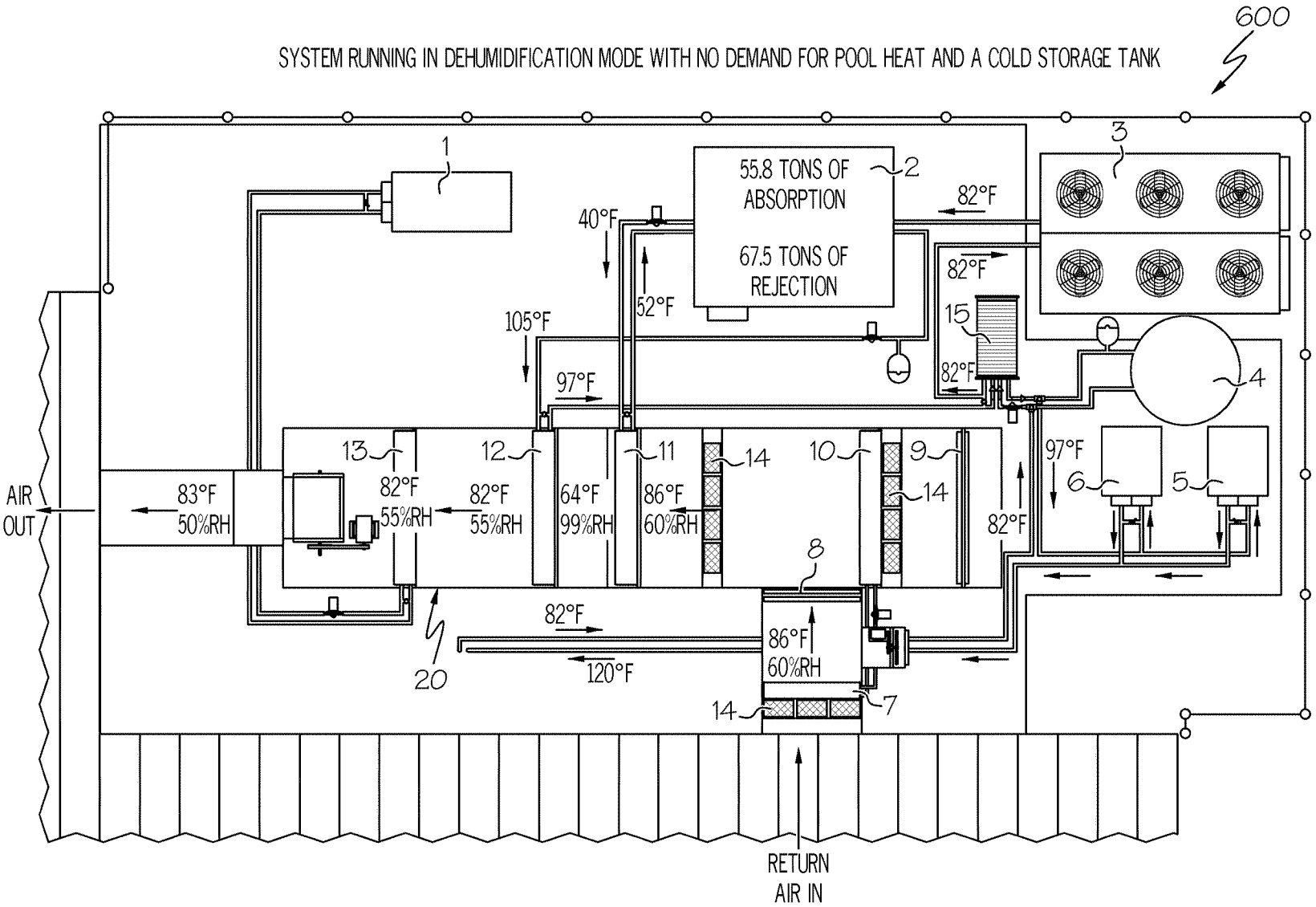
FIG. 6 is a schematic of a dehumidifier/air conditioner system according to a sixth example embodiment of the present invention.

FIG. 6 shows dehumidifier/air conditioner 600 in a dehumidification mode with no demand for pool heat and a cold storage tank. When the swimming pool temperature is at its set point and the hot water storage tank 4 is colder than the condenser water leaving the reheat coil 12, the system rejects heat to the storage tank 4 to later release to the pool. This is accomplished by sending condenser water through the plate frame heat exchanger 15 while also switching the valves over at the storage tank 4 in order to circulate the water in the storage tank 4 back to the plate frame heat exchanger 15. Later if there is a demand for pool heat while the system is not producing hot condenser water, the storage tank water (e.g., warm water) is released to the swimming pool through the related changeover valves. Preferably, according to some example forms, the tank 4 is installed below the level of the pool to prevent it from overrunning the pool when released.

Figure 7:
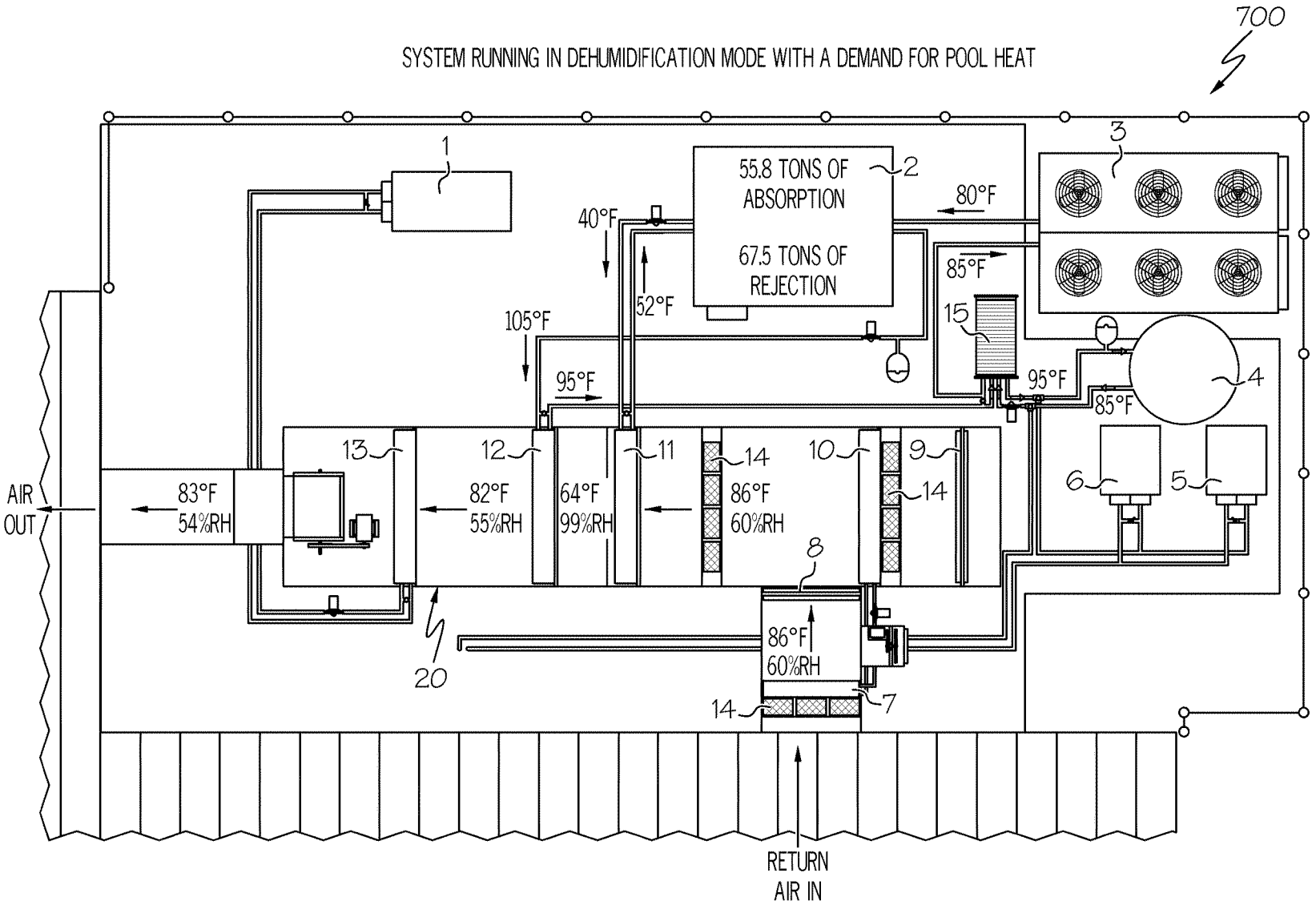
FIG. 7 is a schematic of a dehumidifier/air conditioner system according to a seventh example embodiment of the present invention.

FIG. 7 shows dehumidifier/air conditioner 700 in a dehumidification mode with a demand for pool heat. When the swimming pool temperature is below its set point the system rejects heat to the pool. This is accomplished by sending condenser water through the plate frame heat exchanger 15 to preheat the water going to the pool boilers 5, 6. If the pool temp continues to drop, the PLC will signal the boilers 5, 6 to run and the pool will be brought up to the correct temperature.

Figure 8:
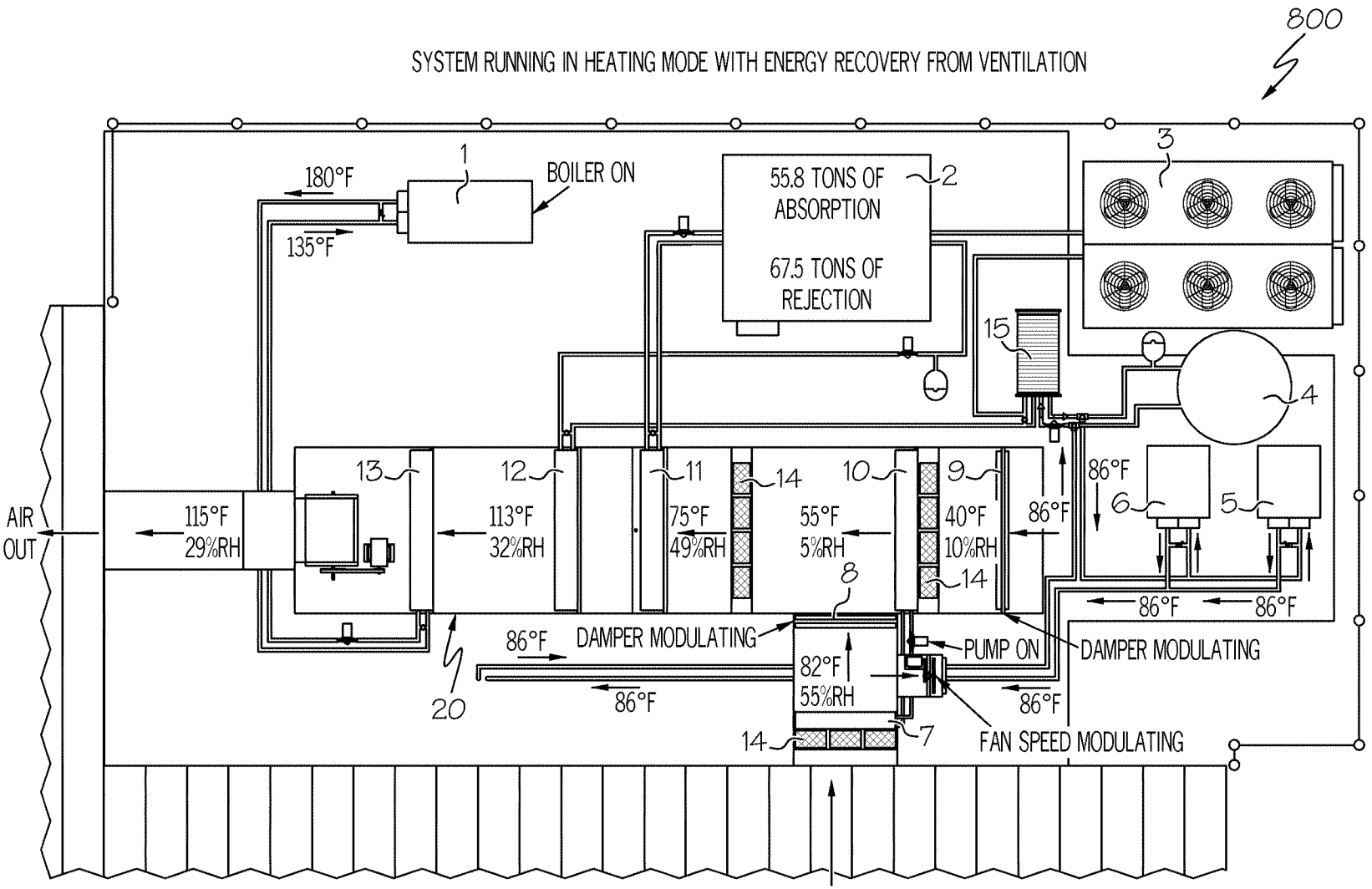
FIG. 8 is a schematic of a dehumidifier/air conditioner system according to an eighth example embodiment of the present invention.

FIG. 8 shows dehumidifier/air conditioner 800 in a heating mode with energy recovery from ventilation. When the return air has a sensible temperature that is lower than the set point the heating mode is initiated. The PLC signals the boiler to come on and the boiler's factory controls allow it to maintain its predetermined set point temperature. The PLC will modulate the three way valve at the hot water coil to maintain space temperature giving the system a PID loop.

According to another example embodiment, the present invention further relates to retrofitting an existing dehumidifier/air conditioner for improved performance. In one example form, the dehumidifier/air conditioner of the present invention utilizes the existing air handler's shell to house the new unit's components. This removes the need for a large crane on the job site thereby saving substantial expense on the replacement of the unit. The first step is to remove all the refrigerant components from inside of the air handler. The customer or operator of the system may elect how many options they want in their new system, depending on factors such as efficiency requirements and expense. FIG. 9 is a table showing the different stages (options) that can be installed to give a customer the unit that best matches their needs and budget. As the customer works their way towards a "Stage #7" unit the initial cost and energy recovery capability of the system grows. According to one example, the cost of a "Stage #1" retrofit system has been calculated to be about ⅓ the cost of a replacement Desert Aire™ unit. According to another example, a "Stage #2" unit is calculated to produce savings up to an estimated $12,000.00 per year in electrical consumption while costing about half the amount of a new/comparable Desert Aire™ unit. Preferably, according to example embodiment of the present invention, the dehumidifier/air conditioner comprises about 20-80 lbs of R410-A, which is substantially less than that of conventional refrigerant based systems. Furthermore, at least one example embodiment of the present invention provides for handling up to 100% outdoor or outside air, thereby giving the ability for the unit to fully economize the structure.

Figure 10:
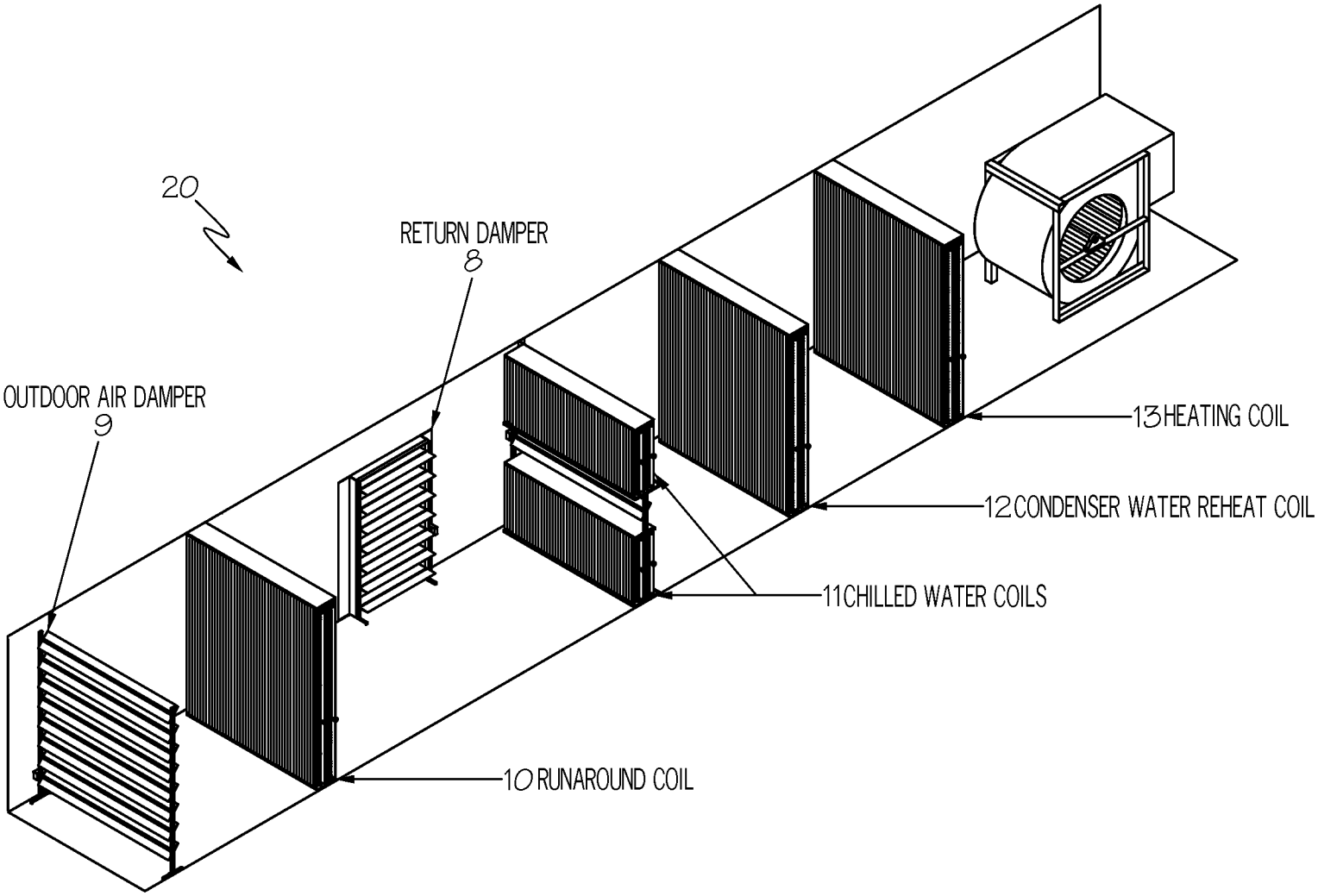
FIGS. 10-12 show additional components and systems according to additional example embodiments of the present invention.
Figure 11:
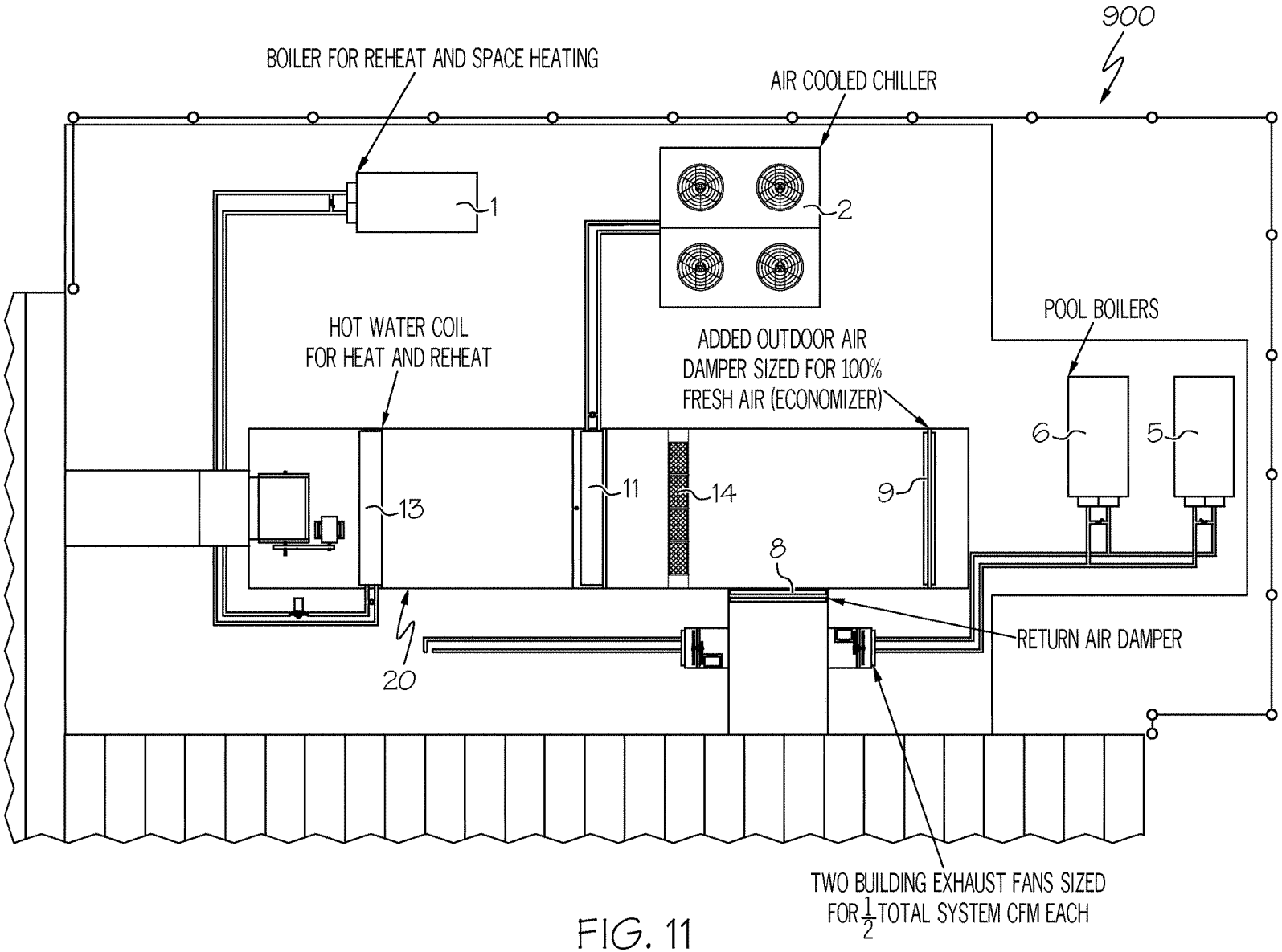
Figure 12:
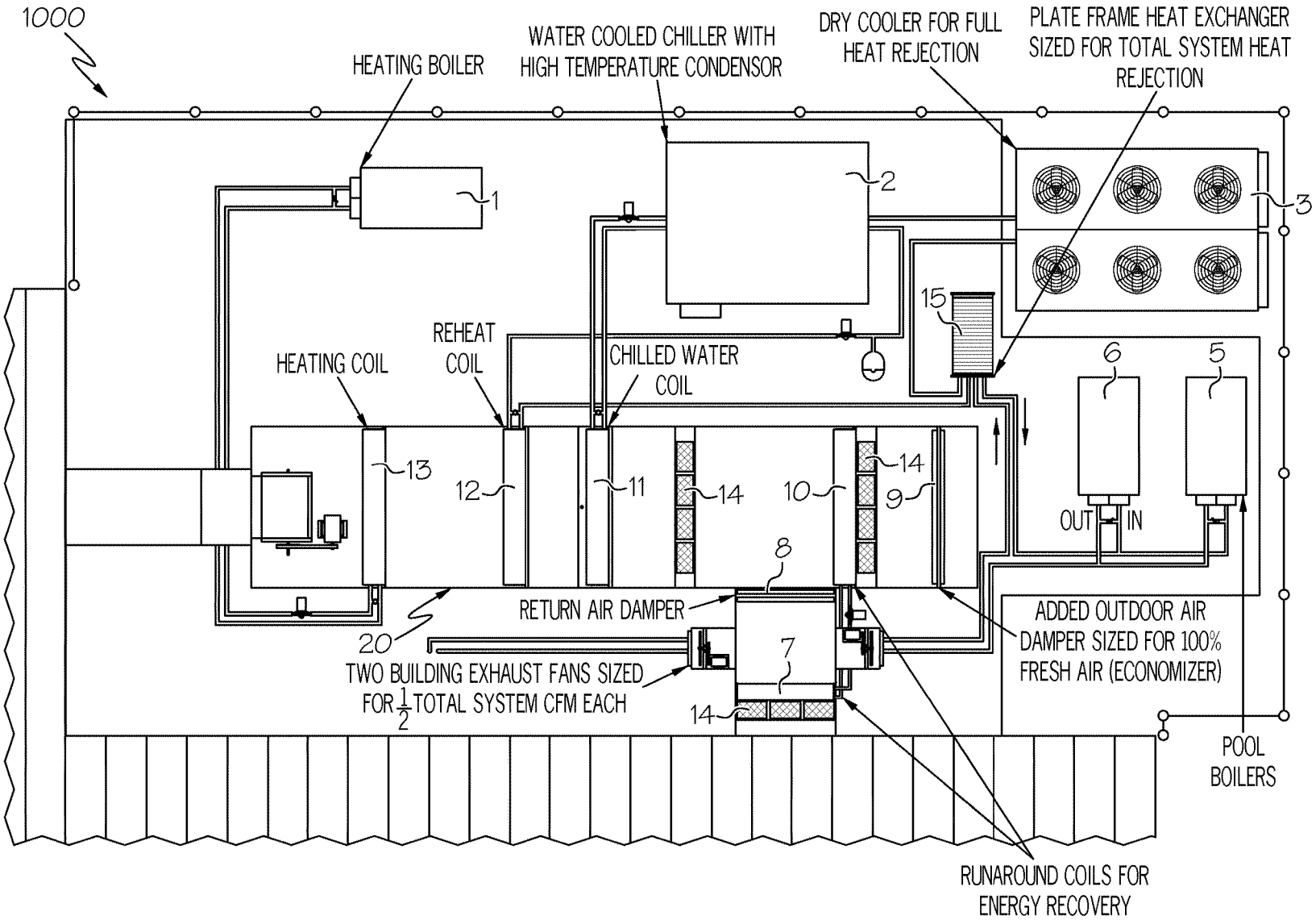

FIGS. 10-12 show additional components and systems according to the present invention. For example, FIG. 10 shows a partially hidden view of the air handler 20. FIG. 11 shows a "Stage #2" retrofit system 900. FIG. 12 shows a "Stage #7" retrofit system 1000.

While the invention has been described with reference to preferred and example embodiments, it will be understood by those skilled in the art that a variety of modifications, additions and deletions are within the scope of the invention, as defined by the following claims.

What is claimed is:

1. A method of dehumidifying/providing air conditioning for a natatorium comprising an enclosure containing a swimming pool, the method comprising:

providing an air handler, the air handler comprising at least a chilled water coil and a heating coil, the air handler comprising a contained volume therein;

providing a chiller, the chiller comprising one or more non-water refrigerant components;

providing a heat exchanger and a hot water storage tank; and isolating the chiller and its one or more non-water refrigerant components from exposure to a chlorinated atmosphere of the natatorium by positioning the chiller and the one or more non-water refrigerant components outside of the air handler such that none of the one or more non-water refrigerant components are located within the contained volume of the air handler.

2. The method of claim 1, wherein by isolating the non-water refrigerant components of the chiller from exposure to the chlorinated atmosphere, servicing of the chiller and/or the one or more of the non-water refrigerant components can be performed without a non-water refrigerant thereof being contaminated by the chlorinated atmosphere.

3. The method of claim 1, further comprising dehumidifying/air conditioning the atmosphere of the natatorium, wherein rejected heat from the dehumidifying/air conditioning heats water through the heat exchanger, and wherein the heated water from the heat exchanger is stored in the hot water storage tank and released to the swimming pool when needed to heat the swimming pool.

4. The method of claim 1, further comprising providing an air damper for operation with the air handler.

5. The method of claim 1, further comprising providing a runaround coil for positioning adjacent the return air damper.

6. The method of claim 1, further comprising providing a runaround coil for positioning adjacent the outdoor air damper.

7. A method of dehumidifying/providing air conditioning for a natatorium comprising an enclosure containing a swimming pool, the method comprising:

providing an air handler, the air handler comprising at least a chilled water coil and a heating coil, the air handler comprising a contained volume therein;

wherein the swimming pool is decontaminated with chlorine such that a chlorinated atmosphere containing chlorinated water vapor is present within a treated air containment space defined by the enclosure of the natatorium and the air handler, providing a chiller having one or more non-water refrigerant components, the chiller and the one or more non-water refrigerant components being positioned outside of the treated air containment space and isolated from exposure to the chlorinated atmosphere;

providing a heat exchanger and a hot water storage tank; and dehumidifying/air conditioning the treated air containment space of the natatorium, wherein rejected heat from the dehumidifying/air conditioning heats water through the heat exchanger, and wherein the heated water from the heat exchanger is stored in the hot water storage tank and released to the swimming pool when needed to heat the swimming pool.

8. The method of claim 7, further comprising servicing the chiller and/or one or more of the non-water refrigerant components, wherein the non-water refrigerant components and the non-water refrigerant thereof remain free from exposure to any chlorinated water vapor such that the contamination thereof is nonexistent.

9. The method of claim 7, further comprising providing an air damper for operation with the air handler.

10. The method of claim 7, further comprising providing a runaround coil for positioning adjacent the return air damper.

11. The method of claim 7, further comprising a runaround coil for positioning adjacent the outdoor air damper.

* * * * *